US006790101B1

(12) United States Patent
Data et al.

(10) Patent No.: US 6,790,101 B1
(45) Date of Patent: Sep. 14, 2004

(54) FEMALE TERMINAL WITH SACRIFICIAL ARC DISCHARGE CONTACTS

(75) Inventors: Mark M. Data, Bolingbrook, IL (US); Arvind Patel, Naperville, IL (US); Yan Margulis, Buffalo Grove, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/620,228

(22) Filed: Jul. 15, 2003

(51) Int. Cl.[7] ..... H01R 11/22
(52) U.S. Cl. ..... 439/851; 439/181
(58) Field of Search ..... 439/851, 856, 439/852, 181, 850, 843

(56) References Cited

U.S. PATENT DOCUMENTS

| | | | | | |
|---|---|---|---|---|---|
| 4,734,041 | A | * | 3/1988 | Bruchmann et al. | 439/637 |
| 4,795,379 | A | * | 1/1989 | Sasaki et al. | 439/856 |
| 4,897,055 | A | | 1/1990 | Jurista et al. | 439/924 |
| 5,135,417 | A | * | 8/1992 | Stanevich | 439/851 |
| 5,176,528 | A | | 1/1993 | Fry et al. | 439/181 |
| 5,554,056 | A | * | 9/1996 | Henricus op ten Berg | 439/851 |
| 5,582,519 | A | | 12/1996 | Buchter | 439/101 |
| 5,591,039 | A | | 1/1997 | Matthewes | 439/181 |
| 5,630,738 | A | * | 5/1997 | Ito et al. | 439/852 |
| 5,676,571 | A | | 10/1997 | Matthews | 439/843 |
| 5,989,078 | A | * | 11/1999 | Chaillot et al. | 439/851 |
| 6,283,774 | B1 | | 9/2001 | Funatsu | 439/181 |
| 6,382,998 | B2 | | 5/2002 | Miwa | 439/181 |
| 6,390,839 | B2 | | 5/2002 | Miwa | 439/181 |
| 6,394,818 | B1 | | 5/2002 | Smalley, Jr. | 439/79 |
| 6,478,593 | B2 | | 11/2002 | Miwa | 439/181 |
| 6,488,549 | B1 | | 12/2002 | Weller et al. | 439/856 |
| 6,537,091 | B2 | | 3/2003 | Hirai et al. | 439/181 |
| 6,537,092 | B2 | | 3/2003 | Hirai et al. | 439/181 |
| 2001/0034167 | A1 | * | 10/2001 | Ketelsleger | 439/851 |
| 2003/0027447 | A1 | | 2/2003 | Cooper | |
| 2003/0049957 | A1 | | 3/2003 | Kikuchi et al. | |

* cited by examiner

*Primary Examiner*—Renee Luebke
*Assistant Examiner*—Felix O. Figueroa
(74) *Attorney, Agent, or Firm*—Stephen Z. Weiss

(57) ABSTRACT

A female terminal with a passageway is defined by generally spaced apart sidewalls for receiving a male terminal. The passageway may be configured from two U-shaped channels, with a primary contact and a sacrificial contact stamped from each sidewall of each U-shaped channel with the sacrificial contacts located forward of the primary contact. The sacrificial contacts are disposed in the direction of insertion of the male terminal into the passageway, and are separated from the sidewall by apertures above and below the sacrificial contact so that any residue from arcing is mostly contained at the edges of the sacrificial contacts.

25 Claims, 5 Drawing Sheets

FEMALE TERMINAL WITH SACRIFICIAL ARC DISCHARGE CONTACTS

CROSS-REFERENCE TO RELATED PATENT APPLICATIONS

This patent application contains common subject matter with another patent application Ser. No. 10/620,229 filed on even date herewith, which is entitled "Flexible Terminal Sidewalls with Flat Angled Surfaces".

FIELD OF THE INVENTION

This invention relates generally to the art of electrical connectors, and, more particularly, to a female or socket terminal for an electrical connector.

BACKGROUND OF THE INVENTION

Mating electrical connectors typically employ pairs of inter-engaging pin arid socket terminals for interconnecting a plurality of circuits or wires 117 through the mated connectors. The pin and socket terminals are often called male and female terminals.

One type of female terminal includes a generally rectangular socket or receptacle at its mating end for receiving a generally rectangular pin or male terminal therein. The mating end is formed by an elongate body defining top and bottom walls and spaced apart opposing sidewalls, thereby defining a passageway for receiving the male terminal. Such terminals are conventionally stamped and formed from sheet material and the top and bottom walls may have open seams or slits, whereby the opposing sidewalls can flex transversely to the longitudinal axis of the terminal to enlarge the passageway as the male terminal is inserted therein.

Many applications require that connectors equipped with these types of terminals be plugged or mated together while electrical power is present at the terminals. Such connectors are known as hot plugable connectors. During mating, and primarily unmating of the terminals in these hot plugable connectors, electrical arcs are created by electrical current passing through the terminals as the terminals are mated or unmated. The terminals may become damaged by such arcing. Furthermore, non-conductive or poorly conducting residues, such as carbon and the like, may build up on the electrical contacts in the terminals due to the arcing. Such residues can interfere with the quality of the electrical contact between the terminals in a subsequent connection.

Some attempts to provide protection against arc discharging in the prior art include providing separate sequential terminals, or providing forward or lateral extensions on the terminals for sequential engagement of the terminals. While effective in reducing the negative effects of arcing, such terminals were larger than necessary due to the extra space required by these forward or lateral extensions. In some cases, these modified terminals were also more complicated to manufacture.

This invention is directed to solving the problems identified above and to satisfying the need for an improved elongated female electrical terminal that has provision for arc discharge.

SUMMARY OF THE INVENTION

An object of the present invention is therefore to provide a new and improved female electrical terminal of the character described.

Another object of the present invention is to provide a means of discharging any arcs between terminals as connectors are hot plugged together.0

A further object of the present invention is to provide one or more sacrificial electrical contacts in a female terminal for engaging the male terminal to discharge any arcs before the male terminal engages the primary electrical contacts.

Yet another object of the present invention is to provide one or more sacrificial contacts in the female terminal that establish and continue electrical contact with a male terminal before initial engagement of one or more primary electrical contacts by the male terminal.

A still further object of the present invention is to provide one or more sacrificial contacts to discharge arcing between male and female terminals by disposing the sacrificial contacts forwardly of the primary contacts in the mating passageway of the female terminal.

Another object of the present invention is to provide a sacrificial contact in the mating passageway of the female terminal in the form of an elongated bar that projects into the passageway to contact the male terminal prior to the male terminal contacting any primary contact.

Yet another object of the present invention is to provide a female terminal, with arc discharge protection for the primary contacts, which is compact and inexpensive to manufacture.

In the exemplary embodiment of the invention, a female terminal has a mating end to receive a male pin with spaced apart flat surfaces and a circuit connecting end for connection to a wire, or the like. The elongate body of the female terminal defines a terminal-receiving passageway with two spaced apart sidewalls extending lengthwise along the passageway. One or more primary terminal contacts are disposed inwardly from at least one of the sidewalls into the terminal-receiving passageway to provide the electrical contact between the female and male terminals when the male terminal is fully inserted into the female terminal. These primary contacts make be of any form or shape, such as dimples formed in the sidewalls of the female terminal. However, these primary terminal contacts are preferably in the form of flat contacting surfaces formed in the opposing sidewalls, and that are disposed at an angle to the sidewalls.

According to one aspect of the present invention, these sacrificial contacts are disposed forwardly of the primary contacts such that the male terminal, when inserted into the passageway will come into contact with the sacrificial contacts before coming into contact with the primary contacts. The sacrificial contacts may be elongated in the direction of insertion of the male terminal into the passageway of the female terminal and have a curved or arcuate surface portion that projects inwardly into the passageway for contacting the male terminal, with apertures separating the elongated sacrificial contacts from the mating end of the female terminal. For example, the portion of the sacrificial contacts that are curved may be spherical in shape.

The sidewalls are resilient and flex apart from each other as the male terminal is inserted in the passageway between the sidewalls and come into engagement with the sacrificial contacts. As the male pin is inserted further into the passageway and engages the primary electrical contacts, the sidewalls continue to flex and separate along an axis generally parallel to their respective sidewalls and in a direction perpendicular to the passageway. Preferably, the primary contacts are in the form of angled and flat contacting surfaces defined in the sidewalls that become generally coplanar with the flat surfaces of the male pin as the sidewalls separate during insertion of the male terminal for improved surface-to-surface contact over substantially entire area of the flat contacting surfaces. The resilient sidewalls then apply normal forces at the flat contacting surfaces against the male pin for improved electrical contact, both with the primary electrical contacts and with the sacrificial contacts.

One or more notches or cuts may be defined in the sidewalls or in the generally U-shaped channels to control or to improve the flexing of the sidewalls when the male pin is inserted into the passageway. Such notches may also better define the bending axis of each sidewall, including control over the flexibility of each sidewall, the normal forces exerted by primary contacts and the sacrificial contacts of the female terminal against the male pin, and the like. These notches will further define the degree of resiliency of the U-shaped channels.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures in which like reference numerals identify like elements, and in which:

DETAILED DESCRIPTION OF THE INVENTION

Figure 1:
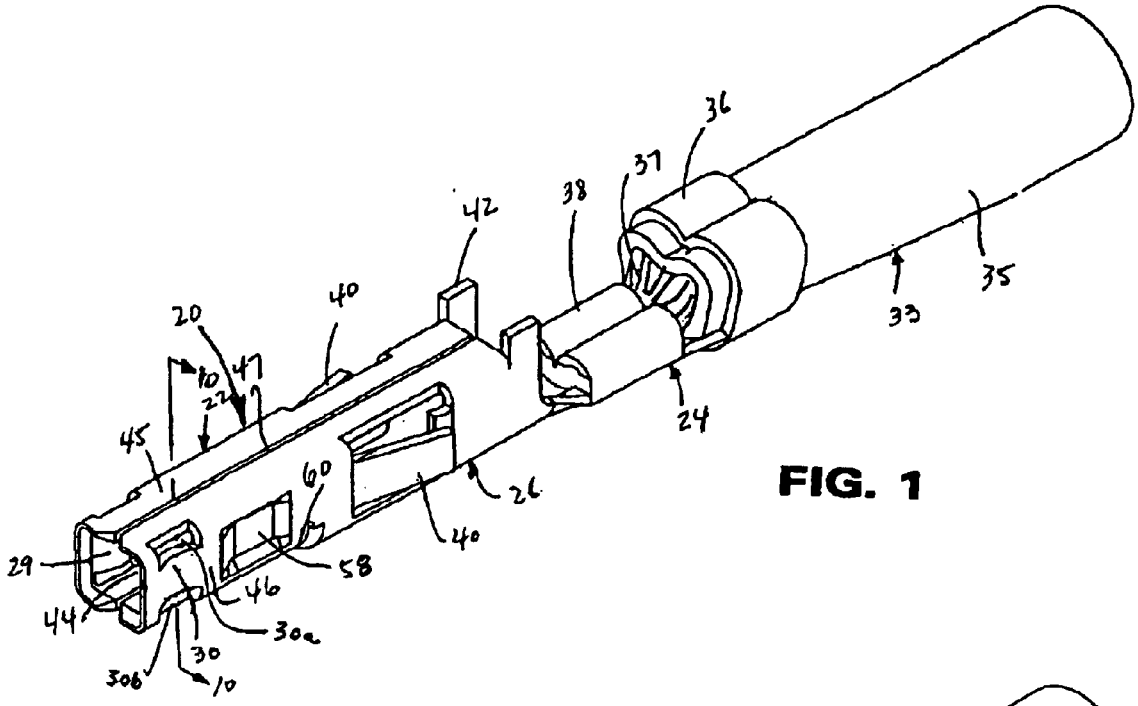
FIG. 1 is a is a top perspective view of a first embodiment of a female electrical terminal with opposed sacrificial contacts formed in opposing sidewalls of the electrical terminal near the mating end of the terminal in accordance with the present invention.

Referring to the drawings in greater detail, and first to FIG. 1, the invention is incorporated in a generally elongate female electrical terminal, generally designated 20. The female terminal includes a mating portion or end, generally designated 22, a terminating portion or end, generally designated 24, and an intermediate securing portion or section, generally designated 26.

The female terminal 20 is stamped and formed from sheet metal material, and the terminating end 24 is constructed for crimping onto an electrical wire, generally designated 33. More particularly, the terminating end of the female terminal includes a rear pair of crimp arms 36 for crimping onto the outer insulation 35 of the electrical wire 33, along with a forward pair of crimp arms 38 for crimping onto a stripped or exposed conductor 37 or conductive core of wire 33.

Intermediate portion 26 of the female terminal 20 includes a pair of stamped and formed locking arms or tabs 40 which project outwardly from opposite sides of the terminal. These locking arms are cantilevered rearwardly and resiliently snap behind locking shoulders 41 in FIG. 4 on the inside of a connector housing, generally designated 28, to prevent the terminal from backing out of housing 28 after the terminal is inserted therein. The intermediate portion 26 may also include a pair of upwardly projecting tabs 42, which engage stop shoulders (not shown) within the connector housing 28 to define the fully inserted position of the female terminal within the housing, and to also stabilize the terminal within the housing against torsional or rotational movement about the longitudinal axis of the terminal.

With reference to FIG. 1, the mating end or portion 22 of the female terminal 20 includes a terminal-receiving passageway 44 adapted to receive a male terminal or pin 50, as will be presented in more detail with respect to FIGS. 6–9, below. Male pin 50 preferably has at least two spaced apart and generally parallel flat sides 51 and 52, such as are provided by a pin with a square or rectangular cross section. Male pin 50 may also have a tapered or wedge-shaped end 50*a* for ease of insertion of the male pin into the passageway 44.

In this embodiment, the mating end 22 of the female terminal is formed of a pair of channels 45 and 46 that are of generally U-shaped cross section, and that are separated by open seams or slits 47 and 48 such that the ends of the legs of the U-shaped channels are spaced adjacently to, but apart from each other. Channels 45–46 thereby define a generally rectangular or square passageway 44 therebetween for receiving the male terminal 50 therein. The bottoms of the U-shaped channels 45–46 are generally flat to define opposed sidewalls 53 and 54 in the passageway 44, as can best be seen in FIGS. 6–9.

Figure 5:
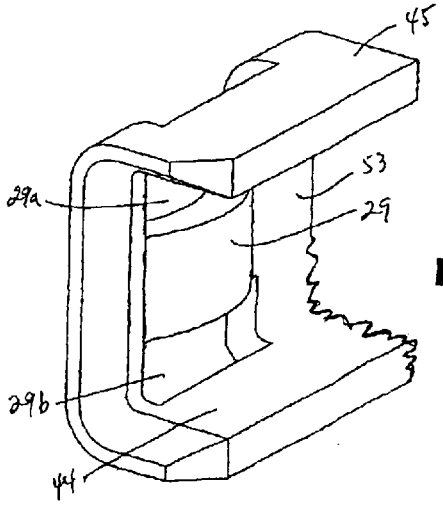
FIG. 5 is an enlarged, partial view of the mating end of the terminal shown in FIG. 1 further illustrating one of the sacrificial contacts formed in one of the sidewalls of the terminal.

In accordance with one aspect of the present invention, at least one arc discharging contact 29 or 30 is disposed in sidewall 53 or 54, respectively, near the open end of passageway 44. Preferably, arc discharging contacts 29–30 are provided in both of the sidewalls 53–54. As best seen in FIG. 5, one of the arc discharging contacts 29 may be integrally formed into the sidewall 53 of channel 45 during the metal stamping and forming processes used to create the female terminal 20, such as by stamping out openings or apertures 29*a* and 29*b*. In the form illustrated in FIG. 5, arc discharging contact 29 is an elongate, small bar of metal that is curved inwardly into the passageway 44 defined between channels 45–46. This generally curved or arcuate shape provides the arc discharging contacts 29–30 with some degree of resiliency to flex against the sides of the male terminal 50. For example, the portion of the arc discharging contact that is curved or arcuate in shape may be spherically shaped.

As used herein, the expressions "sacrificial contacts" and "arc discharging contacts" are used interchangeably and are intended to mean the same thing, namely a contact that discharges an arc between two interconnecting terminals. The electrically conductive quality of such contacts is "sacrificed" since arcs leave deposits of non-conductive or poorly conducting residues on the contacts. Nevertheless, these sacrificial contacts do conduct current and will act as additional contact points if the effects of the arc creating non-conductive residue are not extreme.

Of course, arc discharging contact 29 could be formed in other shapes, such as a ramp that has a peak for engaging the male terminal 50. The elongation of arc discharging contact 29 is in the direction of the insertion of the male terminal 50 into the passageway 44. Preferably, the stamping of apertures 29*a* and 29*b* and 30*a* and 30*b* into the channel 45 and 46 respectively, leaves the arc discharging contacts 29–30 with relatively sharp or abrupt edges along the length of the contacts 29–30. Such sharp or abrupt edges tend to result in arc discharges near the edges of arc discharge contact 29 as well in or near the center of the arc discharge contacts. This will tend to distribute the byproducts of the arc discharges in various locations on the contacts 29–30, instead of concentrating them at or near the point at which the male terminal first comes into contact with the contacts 29–30. One of the primary purposes of the arc discharge contacts 29–30 is to limit the amount of discharge residue between the male terminal 50 and the primary electrical contacts 57–58 by causing the arc discharges between the male and female terminals 50, 20, respectively, to occur at the separately located arc discharge contacts, and away from the primary contacts 57–58. Of course, as the arc discharge contacts rub against the sides of the male terminal, the high points of the contacts will tend to be cleaned by the friction between the contacts and the male terminal.

If desired, more than one arc discharge contact, similar to contacts 29–30, may be disposed near the entrance to passageway 44. For example, two narrower arc discharge contacts could be disposed in each sidewall 53–54, with one contact disposed above the other on the sidewalls. This would yield three apertures defined in each sidewall above and below the two arc discharge contacts. These narrower arc discharge contacts would also tend to have a greater degree of resiliency or flexibility for those applications where such characteristics are desirable.

Enlarged primary contacts 57 and 58 are provided in the passageway 44 to engage and to provide the primary electrical contact between the mating pin 50 and the female terminal 20. These enlarged contacts 57–58 can, for example, be formed in the respective sidewalls 53–54 by metal forming and stamping techniques that are known in the art. As shown in FIG. 1, the enlarged primary contacts 57–58 are preferably elongated in the longitudinal direction of the female terminal, and in the longitudinal direction of the passageway 44 to provide an increased area of contact between the male pin and the enlarged contact areas provided by the primary contacts 57–58 of the female terminal for superior electrical contact and characteristics.

Figure 6:
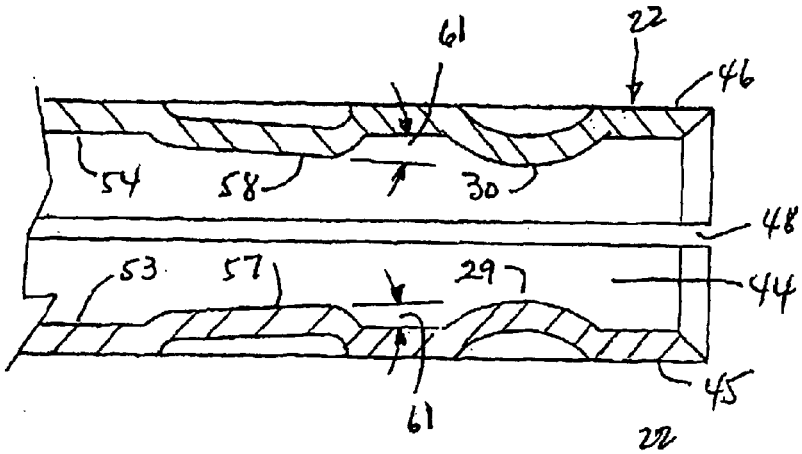
FIG. 6 is an enlarged cross sectional view of the mating end of the electrical terminal shown in FIG. 1 further illustrating the sacrificial contacts disposed in front of enlarged and angled primary contacts.

FIGS. 6–9, sequentially illustrate the insertion of the male terminal 50, which is in this embodiment is in the form of a generally rectangular pin, into the mating portion 22 of the female terminal 50. FIG. 6 illustrates the condition in which no male terminal 50 is in the passageway 44. Note that the slit 48 between the channels 45–46 is of generally uniform width.

Figure 7:
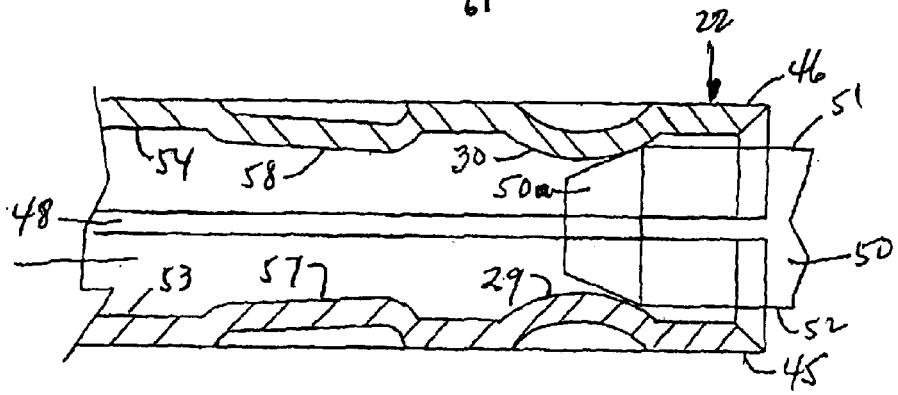
FIG. 7 is also an enlarged cross sectional view of the mating end of the electrical terminal, similar to FIG. 6, but with a male pin partially inserted into the mating end of the female terminal such that the tapered end of the male pin initially engages the sacrificial contacts.

FIG. 7 illustrates the condition in which male terminal 50 is beginning to be inserted into the passageway 44. The tapered end 50*a* of terminal 50 just contacts the arc discharging contacts 29–30. At this time, if there is a voltage potential between the male and female pins, 50, 20, as may be the case with hot plugable connectors, an arc discharge may occur between male terminal 50 and one or both of the arc discharge contacts 29–30.

Figure 8:
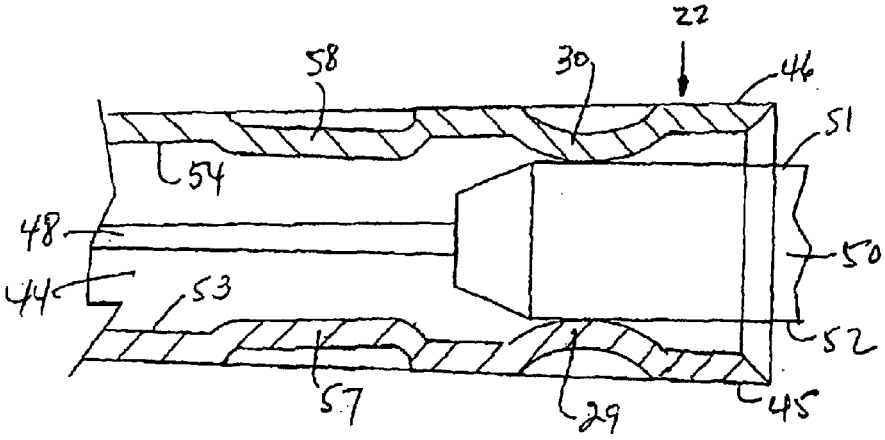
FIG. 8 is another enlarged cross sectional view of the mating end of the electrical terminal, similar to FIGS. 6 and 7, but with a male pin further inserted into the mating end of the female terminal such that the sides of the male pin engage the sacrificial contacts before the male terminal engages the enlarged and angled primary contacts of the female terminal.

FIG. 8 illustrates the condition in which the male terminal 50 is further inserted into the passageway 44, such that sidewalls 51–52 of male terminal 50 now engage the arc discharge contacts 29–30. The opposed channels 45–46 which define the passageway 44 are resilient and permit the wedge shaped end 50*a* of the male pin 50 to flex the channels 45–46 apart as the male pin initially engages the arc discharging contacts 29–30 and then the enlarged primary contacts 57–58 as the male terminal 50 is inserted in the passageway 44. As this occurs, the slits 47–48 open to a greater separation at the mating end 22 of the female terminal 20 near the arc discharge contacts 29–30. That is, as the male pin is inserted into the passageway 44, channels 45–46 rotate along an axis perpendicular to the male terminal insertion direction, to expand the passageway 44 between the arc discharge contacts 29–30 to accommodate insertion of male pin 50 into the passageway 44.

Figure 9:
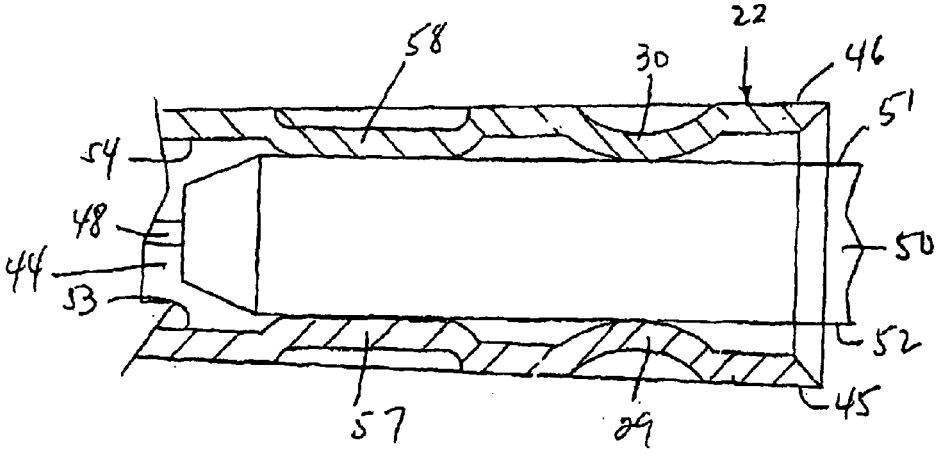
FIG. 9 is yet another enlarged cross sectional view of the mating end of the electrical terminal, similar to FIGS. 6–8, but with a male pin fully inserted into the mating end of the female terminal such that the sides of the male pin engage both the sacrificial contacts and the enlarged and angled primary contacts of the female terminal.
Figure 10:
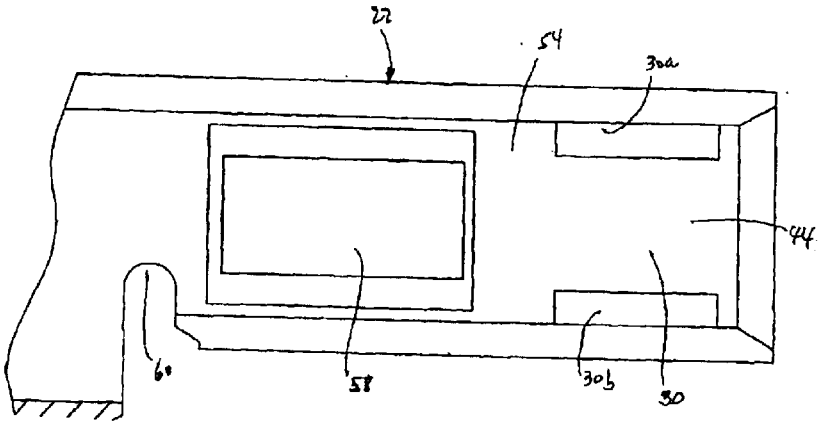
FIG. 10 is a partial cross sectional view of the interior of the mating end of the electrical connector illustrated in FIG. 1 taken along section lines 10—10.

FIG. 9 illustrates the complete insertion of male pin 50 into passageway 44. As this occurs, the slits 47–48 open further at the mating end 22 of the female terminal 20 near the enlarged primary electrical contacts 57–58. The resiliency of channels 45–46 holds and biases the enlarged primary contacts 57–58 and the arc discharge contacts 29–30 against the male pin 50 by applying normal forces thereto to maintain an improved electrical contact between the male pin and the female terminal. When male terminal 50 is fully inserted into the passageway, as shown in FIG. 9, the normal forces are applied equally between the primary contacts 57–58 and the arc discharge contacts 29–30, for best electrical contact performance.

It will be appreciated that the force per unit area exerted by the enlarged contact areas against the male pin may typically be considerably less than with the prior art dimples. Thus, the primary contacts 57–58 are less likely to have any plating on the enlarged contact areas worn off by repeated insertion cycles of the male pin 50 into the female terminal 20. The metal plating on primary contacts is therefore able to survive many more insertion cycles than the terminals with the prior art dimples.

A notch or recess 60 in FIG. 1 may be stamped, machined or otherwise provided in at least one of the channels 45, and preferably both of the channels 45–46, to affect and to control the flexing and rotation of the channels 45–46 when the male pin 50 is inserted into the passageway 44. This notch can be particularly effective if it is disposed rearwardly of the enlarged contact areas, such as in a transition area between the mating end 22 and the intermediate portion 26 of the female terminal. Thus, channels 45 and 46, rather than flexing mostly along their length, tend to rotate at the area of reduced metal near or around notch 60. Notch 60 therefore better defines the flexing of the sidewalls in the area of the notch and provides improved control of the resiliency of the channels 45–46. Notch 60 thereby also provides a means of controlling and defining the normal forces that the channels 45–46 exert against the male pin 50 at the enlarged primary contacts 57–58.

As can be seen in FIG. 6, the enlarged contacts 57–58 are formed in the sidewalls 53–54 of the channels 45–46 at an angle 61 to the sidewalls 53–54, respectively. FIG. 6 represents the terminal mating end 22 of the female terminal 20 when the male pin 50 is not inserted therein. In this condition, the slit 48 may provide generally uniform separation between the channels 45–46. In the unbiased condition of the mating end 22 illustrated in 6, the angle 61 that the enlarged contacting surfaces 57–58 are disposed at with respect to the sidewalls 53–54 will depend upon a number of factors including the longitudinal length of the mating end 22, the resiliency of the channels 45–46, the location of the enlarged contacts along the sidewalls of the mating end 22, the location of any notches 60, and the like. However, in the embodiment illustrated in FIGS. 6–9, angle 61 may typically be in a range of about 1 to 10 degrees and preferably approximately 1 to 5 degrees.

FIG. 9 illustrates the mating end 22 of the female terminal with the male pin 50 fully inserted therein. In this condition, the channels 45–46 are biased apart along the slits 47–48 as the channels 45–46 flex or rotate apart to accommodate male pin 50. Since the arc discharging contacts 29–30 and enlarged primary contacts 57–58 are disposed near the front or entrance to the passageway 44, maximum separation between the channels 45–46 occurs at the front of the mating end 22, with less separation rearwardly towards the intermediate portion 26 of the female terminal. Thus, as the channels 45 and 46 rotate away from each other as the male pin 50 is inserted in the passageway 44, the previously angled and enlarged primary contacts 57–58 now become substantially coplanar with the flat sides of the male pin 50 along with discharge contacts 29–30 to substantially contact the male pin along the enlarged surfaces of contacts 57–58.

Figure 2:
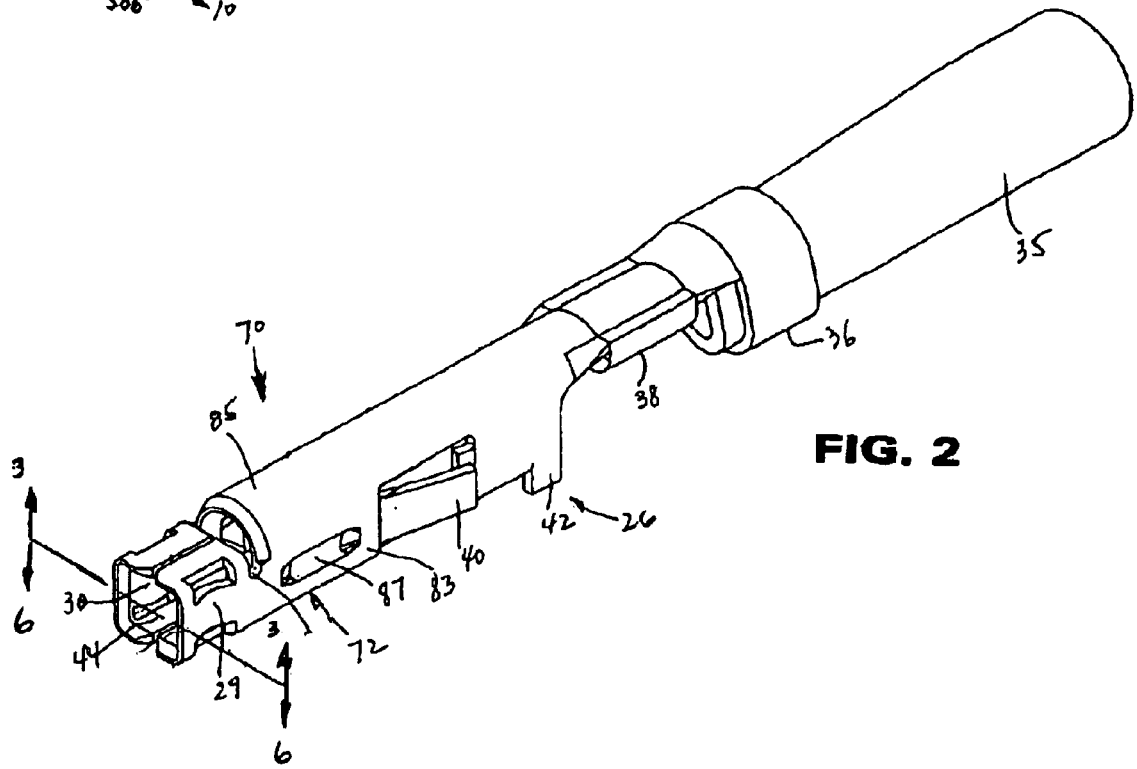
FIG. 2 is a bottom perspective view of a second embodiment of the female electrical terminal also provided with opposed sacrificial contacts formed in the opposing sidewalls of the electrical terminal near the mating end of the terminal.
Figure 3:
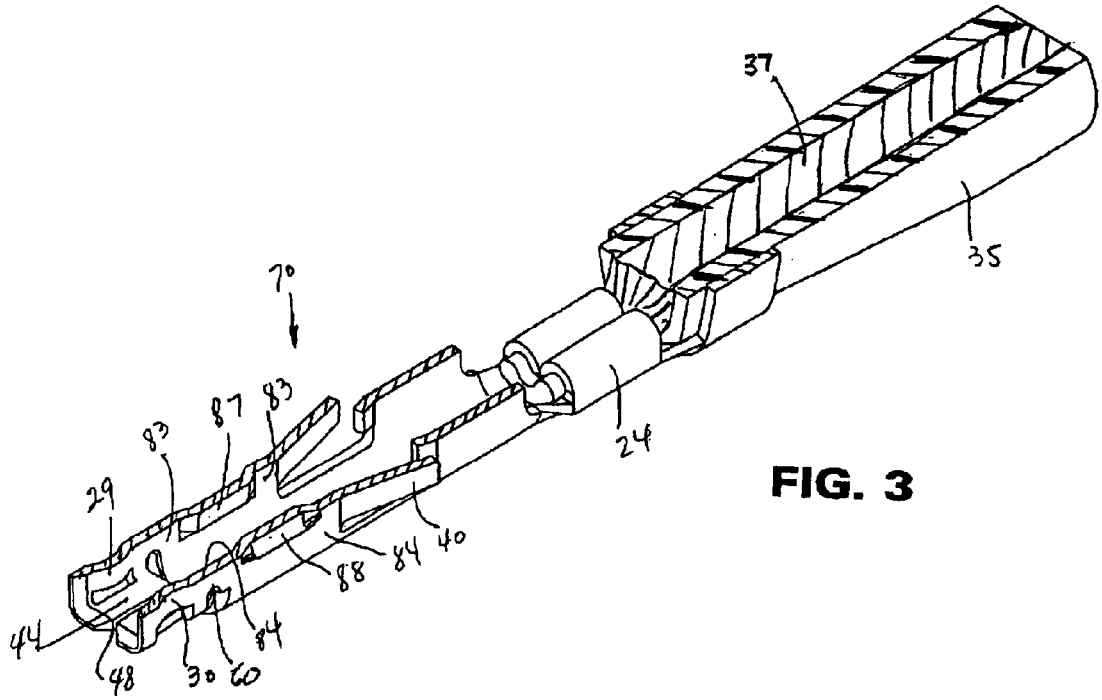
FIG. 3 is a longitudinal sectional view of the electrical terminal of FIG. 2 taken along section lines 3—3 to further illustrate the opposed sacrificial contacts formed in opposed sidewalls of the terminal.
Figure 4:
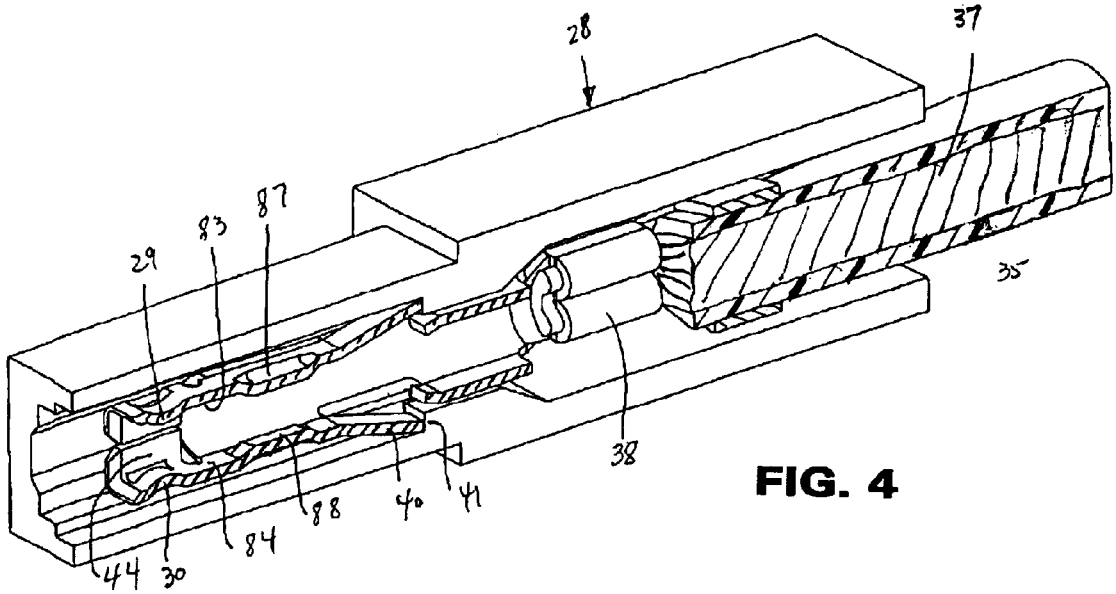
FIG. 4 is a longitudinal sectional view of the electrical terminal similar to that of FIG. 3, but with the terminal inserted into a connector housing.

FIGS. 2–4 illustrate an alternative embodiment of the present invention in which a female terminal, generally designated 70, has a portion of the mating end, generally designated 72, of the terminal is configured in a manner somewhat similar to the intermediate portion 26 of the female terminal 20 in FIGS. 1 and 6–10. In particular, the mating end 72 of female terminal 70 in the vicinity of the enlarged primary contacts 87–88 has a pair of generally parallel and spaced apart sidewalls 83 and 84 that are integrally connected by a curved bight 85. The other edges of sidewalls 83–84 are bent at an approximate right angle to form legs that terminate short of each other to define a slit, which extends longitudinally along the body of the terminal.

At least one enlarged contact area 87 or 88, and preferably two enlarged contacts 87–88 are formed in the sidewalls 83–84 of the terminal, such as in the mating end 72. These contacts 87–88 are preferably disposed at an angle to the sidewalls 83–84. In this embodiment, the angle depends upon various factors, but will generally be in the approximate range of 5 to 15 degrees.

Unlike the angled contacts 57–58 of female terminal 20 in FIGS. 1 and 6–10, which are angled to the sidewalls in the longitudinal direction, angled contacts 87–88 of female terminal 70 are angled with respect to the sidewalls in the transverse direction. This is because female terminal 70 expands in the transverse direction to accommodate insertion of male pin 50 into the passageway 94 of terminal 70. The flexing in terminal 70 occurs mostly in the area of the bight 85 such that sidewalls 83–84 rotate apart from each other as the male pin is inserted in passageway 44. As the sidewalls 83 and 84 rotate apart, the previously angled primary contacts 87 and 88 become substantially coplanar with the flat sides of the male pin for improved electrical contact therewith.

However, that portion of the mating end 72 of the female terminal 70 of FIGS. 2–4, which includes the arc discharging contacts 29–30, remains configured and functions in a manner similar to the arc discharging contacts 29–30 of the female terminal 20 of FIGS. 1 and 6–10, which is described above.

Figure 11:
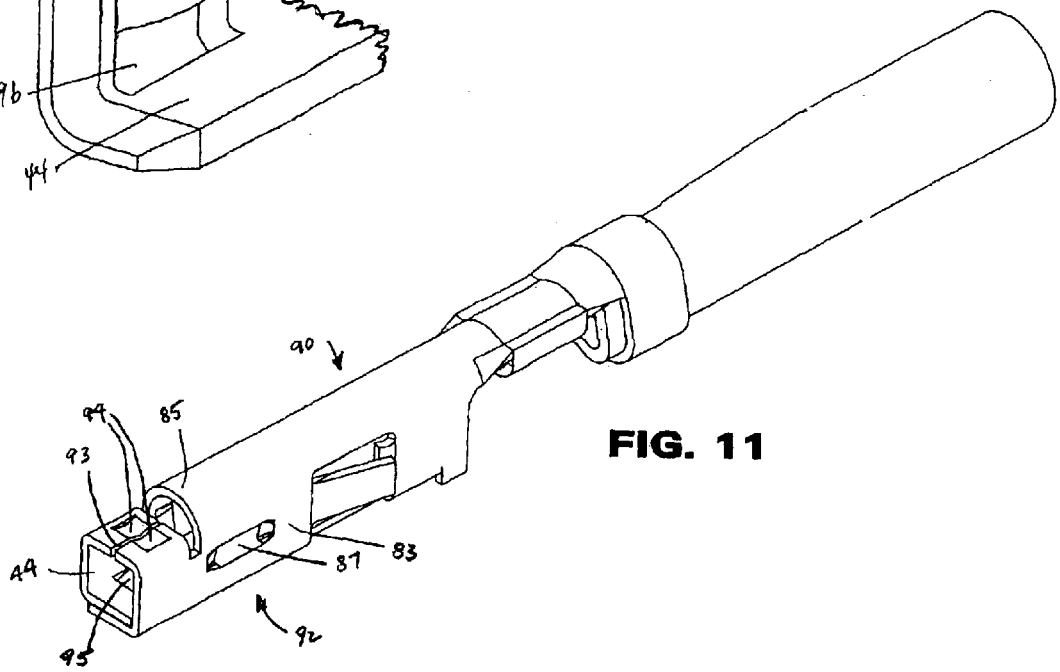
FIG. 11 is a bottom perspective view of a third embodiment with sacrificial contacts formed in opposing legs bent from the sidewalls.
Figure 12:
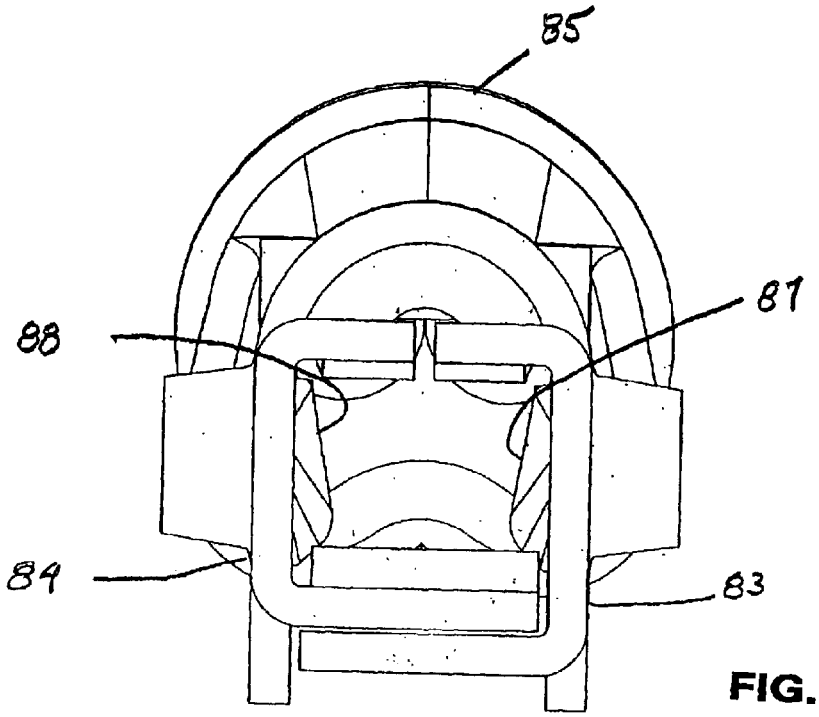
FIG. 12 is a side view of the electrical terminal shown in FIG. 11.
Figure 13:
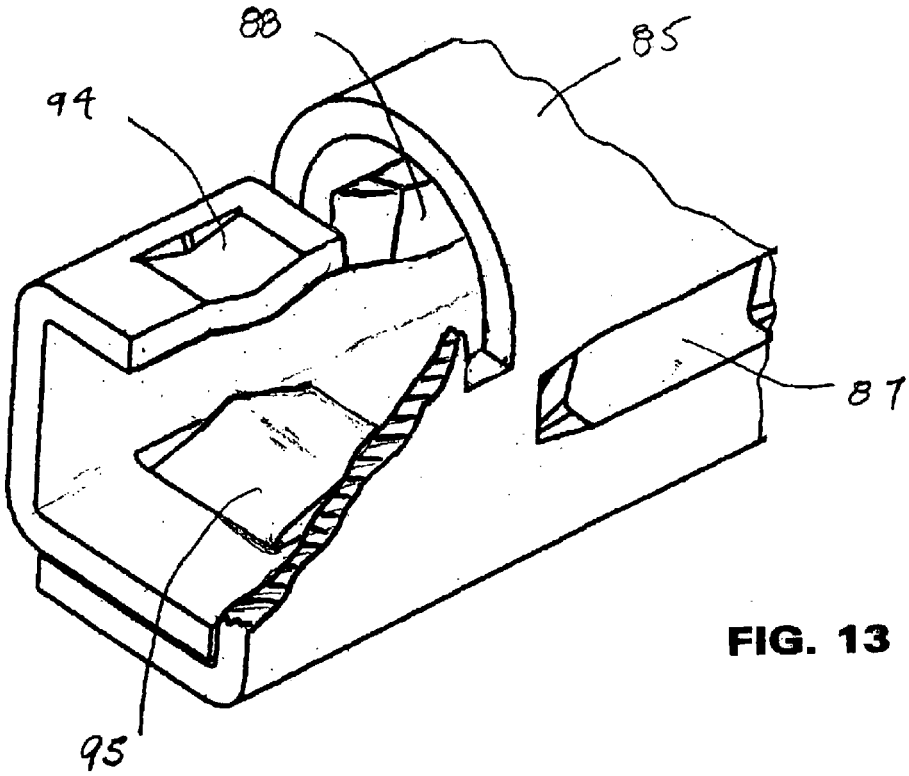
FIG. 13 is a partial section view of the mating end of the terminal shown in FIG. 11.

FIGS. 11–13 illustrate a third embodiment of the present invention in which a female terminal, generally designated 90, has a portion of the mating end, generally designated 92, being configured in a manner somewhat similar to the intermediate portion 26 of the female terminal 70 in FIGS. 24. The mating end 92 of female terminal 90 in the vicinity of the enlarged primary contacts 87–88 has a pair of generally parallel and spaced apart sidewalls 83 and 84 that are integrally connected by a curved bight 85. The edges of sidewalls 83–84 are bent at an approximate right angle to form two pair of legs. Like the terminal in FIGS. 2–4, a first pair of legs terminate short of each other to define a slit 93, which extends longitudinally along the body of the terminal. However, unlike the terminal appearing in FIGS. 2–4, a second pair of legs are longer than the first pair of legs and overlap one another. Another difference is that the arc discharge contacts in this third embodiment are not in the side walls. In this third embodiment each leg of the first pair of legs bent from the sidewalls have arc discharge contacts 94 extending into the passageway 44. Also the overlapped leg closest to the passageway 44 has one arc discharge contact 95, in the form of a cantilevered beam, extending into the passageway 44 generally opposite the arc discharge contacts 94.

The angled contacts 87–88 of female terminal 90, like female terminal 70 in FIGS. 2–4, are angled with respect to the sidewalls in the transverse direction. As the male pin 50 in inserted into the passageway 44 of terminal 90, the sidewalls 83–84 flex about bight 85 apart from each other. As the sidewalls 83 and 84 rotate apart, the previously angled primary contacts 87 and 88 become substantially coplanar with the flat sides of the male pin for improved electrical contact therewith. The cantilevered arc discharge beam 95 forces the male pin 50 into engagement with the arc discharge contacts 94 during the initial insertion of the pin into the passageway 44 and after further insertion as the sidewalls 83–84 rotate apart. In this arrangement the sacrificial arc discharge contacts 94, 95 will engage two sides of pin 50 while the primary contacts 87, 88 will engage two other sides of pin 50. Accordingly, any non-conductive residue created by the sacrificial arc discharge contacts 94, 95 engaging two sides of the male pin, will not contact the primary contacts 87, 88 which engage the other two sides of the pin resulting in a better electrical engagement between the male and female terminals.

It is to be understood that such terms as "top", "bottom" or the like, as used herein and in the claims hereof, are used as relative terms only in order to provide a more clear and concise understanding of the invention. Such terms are not to be construed as limiting, because the terminals of the present invention may be oriented in many different directions in actual use, as is well known to persons skilled in the art.

It will be understood that the invention may be embodied in other specific forms without departing from the spirit or central characteristics thereof. The present examples and embodiments are, therefore, to be considered in all respects as illustrative and not restrictive, and the invention is not to be limited to the details given herein.

What is claimed is:

1. The female terminal for receiving and mating with a male terminal of a type having at least one flat surface extending longitudinally along the male terminal, said female terminal comprising:

a terminal body with a mating end and a circuit connecting end;

a terminal receiving passageway defined in the mating end including two spaced apart sidewalls extending lengthwise along the passageway, said sidewalls arranged to resiliently flex away from each other as the male terminal is inserted into the male terminal;

at least one inwardly projecting primary contact stamped from one of said sidewalls and held to the one sidewall by at least two opposite ends of the primary contact, for engaging said at least one flat surface of the male terminal when the male terminal is inserted into the terminal receiving passageway; and at least one inwardly projecting elongated arc discharging contact, the direction of the elongation generally parallel to the longitudinal direction of the passageway, stamped from said one of said sidewalls with an aperture defined in the sidewall above and below said elongated arc discharge contact and held to the one sidewall by at least two opposite ends of the arc discharging contact, forwardly of said primary contact in said terminal receiving passageway such that said male terminal comes into contact with said arc discharging contact before coming into contact with the primary contact as the male terminal is inserted into the terminal receiving passageway, whereby any arc discharge between the male and female terminals occurs at the arc discharging contact.

2. The female contact as claimed in accordance with claim 1 wherein an inwardly projecting primary contact is disposed on each of said two spaced apart sidewalls, and an inwardly projecting arc discharge contact is disposed on each of said two spaced apart sidewalls.

3. The female contact as claimed in accordance with claim 1 wherein said at least one arc discharge contact has sharply formed edges along said apertures.

4. The female contact as claimed in accordance with claim 1 wherein said at least one arc discharge contact has a portion that is curved inwardly into the passageway for contacting the male terminal as the male terminal is inserted into the passageway.

5. The female contact as claimed in accordance with claim 4 wherein said inwardly curved portion of the arc discharge contact is spherically shaped.

6. The female contact as claimed in accordance with claim 1 wherein each of said sidewalls is of generally U-shaped cross section and wherein legs of the U-shaped cross sections are spaced apart from each other to define at least one longitudinal slit extending lengthwise along the terminal receiving passageway.

7. The female terminal as claimed in accordance with claim 6 wherein said U-shaped cross sections of the sidewalls of the female terminal flex upon insertion of the male terminal into the passageway and upon engagement of the male terminal between said at least one arc discharging contact and between said at least one inwardly projecting primary contact, said sidewalls providing normal forces at said at least one inwardly projecting primary contact against the male terminal to provide electrical contact between the male and female terminals.

8. The female terminal as claimed in accordance with claim 1 wherein said sidewalls flex about an axis generally parallel to a respective sidewall and in a direction perpendicular to the terminal receiving passageway when said male terminal is inserted into said passageway.

9. The female terminal as claimed in accordance with claim 1 wherein said sidewalls resiliently rotate away from each other when the male terminal is inserted into said passageway.

10. The female terminal as claimed in accordance with claim 1 wherein a notch is made partially into at least one of the sidewalls of the female terminal to control the flexing of the sidewall when the male terminal is inserted into the passageway.

11. A female terminal for receiving and mating with a male terminal of the type having at least two opposite flat surfaces extending longitudinally along the male terminal, said female terminal comprising:

a terminal body with a mating end and a circuit connecting end;

a terminal receiving passageway defined in the mating end including two opposed spaced apart sidewalls extending lengthwise along the passageway, said sidewalls arranged to resiliently flex away from each other as the male terminal is inserted into the male terminal;

an inwardly projecting primary contact stamped from each of said sidewalls and held to the one sidewall by at least two opposite ends of the primary contact, for engaging said opposite flat surfaces of the male terminal when the male terminal is inserted into the terminal receiving passageway; and an inwardly projecting elongated arc discharging contact the direction of elongation generally parallel to the longitudinal direction of the passageway, stamped from each of said sidewalls with an aperture defined in the sidewall above and below said elongated arc discharge contact and held to each sidewall by at least two opposite ends of the arc discharging contact, forwardly of said primary contacts in said terminal receiving passageway such that said male terminal comes into contact with said arc discharging contacts before coming into contact with the primary contacts as the male terminal is inserted into the terminal receiving passageway, whereby any arc discharge between the male and female terminals occurs at the arc discharging contacts.

12. The female contact as claimed in accordance with claim 11 wherein said arc discharge contacts have sharply formed edges along said apertures.

13. The female contact as claimed in accordance with claim 11 wherein said arc discharge contacts each have a portion that is curved inwardly into the passageway for contacting the male terminal as the male terminal is inserted into the passageway.

14. The female contact as claimed in accordance with claim 13 wherein said inwardly curved portion of each of the arc discharge contacts is spherically shaped.

15. The female contact as claimed in accordance with claim 11 wherein each of said sidewalls includes at least one leg bent from each sidewall extending toward the opposed sidewall and wherein at least one of the legs includes one arc discharge contact.

16. The female terminal as claimed in accordance with claim 15 wherein both of said legs include an arc discharge contact.

17. The female contact as claimed in accordance with claim 11 wherein each of said sidewalls is of generally U-shaped cross section with legs bent from each sidewall extending toward the opposed sidewall and wherein the legs of the U-shaped cross sections are spaced apart from each other to define at least one longitudinal slit extending lengthwise along the terminal receiving passageway and further wherein one of said arc discharge contacts is disposed in one of said legs adjacent said one longitudinal slit.

18. The female terminal as claimed in accordance with claim 11 wherein said sidewalls flex about an axis generally parallel to a respective sidewall and in a direction perpendicular to the terminal receiving passageway when said male terminal is inserted into said passageway.

19. The female terminal as claimed in accordance with claim 11 wherein said sidewalls resiliently rotate away from each other when the male terminal is inserted into said passageway.

20. The female terminal as claimed in accordance with claim 11 wherein a notch is made partially into at least one of the sidewalls of the female terminal to control the flexing of the sidewall when the male terminal is inserted into the passageway.

21. The female contact as claimed in accordance with claim 11 wherein each of said sidewalls includes at least one leg bent from each sidewall extending toward the opposed sidewall and wherein at least one of the legs includes one arc discharge contact.

22. The female terminal as claimed in accordance with claim 21 wherein both of said legs include an arc discharge contact.

23. The female terminal as claimed in accordance with claim 21 wherein each of said sidewalls is of a generally U-shaped cross section with legs bent toward an opposed sidewall wherein the legs of the U-shaped cross sections are spaced so that two of the legs are spaced apart to define one longitudinal slot extending lengthwise along the terminal receiving passageway and each having a first arc discharge contact disposed therein and projecting toward said passageway, and at least one leg opposite the two spaced apart legs, bent from one sidewall toward the other sidewall with a second arc discharge contact disposed therein and opposed to said first arc discharge contacts in said opposed legs.

24. A female terminal for receiving and mating with a male terminal of a type having at least one flat surface extending longitudinally along the male terminal, said female terminal comprising:

a terminal body with a mating end and a circuit connecting end;

a terminal receiving passageway defined in the mating end including two spaced apart sidewalls extending lengthwise along the passageway, said sidewalls arranged to resiliently flex away from each other as the male terminal is inserted into the male terminal;

at least one inwardly projecting primary contact, having a flat contacting surface disposed at an angle to the sidewall and becoming substantially coplanar with the at least one flat surface on the male terminal when the male terminal is inserted into the passageway, the primary contact being elongated in a direction of insertion of the male terminal in the passageway, stamped from one of said sidewalls, and held to the one sidewall by at least two opposite ends of the primary contact, for engaging said at least one flat surface of the male terminal when the male terminal is inserted into the terminal receiving passageway; and at least one inwardly projecting arc discharging contact stamped from said one of said sidewalls and held to the one sidewall by at least two opposite ends of the arc discharging contact, forwardly of said primary contact in said terminal receiving passageway such that said male terminal comes into contact with said arc discharging contact before coming into contact with the primary contact as the male terminal is inserted into the terminal receiving passageway, whereby any arc discharge between the male and female terminals occurs at the arc discharging contact.

25. A female terminal for receiving and mating with a male terminal of the type having at least two opposite flat surfaces extending longitudinally along the male terminal, said female terminal comprising:

a terminal body with a mating end and a circuit connecting end;

a terminal receiving passageway defined in the mating end including two opposed spaced apart sidewalls extending lengthwise along the passageway, said sidewalls arranged to resiliently flex away from each other as the male terminal is inserted into the male terminal;

an inwardly projecting primary contact stamped from each of said sidewalls and held to the one sidewall by at least two opposite ends of the primary contact, for engaging said opposite flat surfaces of the male terminal when the male terminal is inserted into the terminal receiving passageway, each of said inwardly projecting primary contacts having a flat contacting surface disposed at an angle to the respective sidewall and becoming substantially coplanar with the opposite flat surfaces on the male terminal when the male terminal is inserted into the passageway, the flat contacting surface being elongated in a direction of insertion of the male terminal in the passageway; and an inwardly projecting arc discharging contact stamped from each of said sidewalls and held to each sidewall by at least two opposite ends of the arc discharging contact, forwardly of said primary contacts in said terminal receiving passageway such that said male terminal comes into contact with said arc discharging contacts before coming into contact with the primary contacts as the male terminal is inserted into the terminal receiving passageway, whereby any arc discharge between the male and female terminals occurs at the arc discharging contacts.

* * * * *